US008328464B2

(12) United States Patent
Sina et al.

(10) Patent No.: US 8,328,464 B2
(45) Date of Patent: Dec. 11, 2012

(54) VIBRATORY ROLLER WITH COMPOSITE EXCITER DRIVE GEAR

(75) Inventors: Paul Sina, Jackson, WI (US); Scott Kruepke, West Bend, WI (US); Brian White, Wauwatosa, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 0 days.

(21) Appl. No.: 13/020,976

(22) Filed: Feb. 4, 2011

(65) Prior Publication Data

US 2012/0201602 A1 Aug. 9, 2012

(51) Int. Cl.
*E01C 19/38* (2006.01)

(52) U.S. Cl. ..... 404/117

(58) Field of Classification Search ..... 404/117, 404/122

See application file for complete search history.

(56) References Cited

U.S. PATENT DOCUMENTS

| | | | | |
|---|---|---|---|---|
| 3,736,066 | A * | 5/1973 | Koontz | 404/117 |
| 3,882,949 | A | 5/1975 | Anderson | |
| RE29,115 | E | 1/1977 | Rouverol | |
| 4,337,672 | A | 7/1982 | Shiber | |
| 4,647,247 | A * | 3/1987 | Sandstrom | 404/75 |
| 4,732,507 | A | 3/1988 | Artzberger | |
| 5,082,396 | A | 1/1992 | Polacek | |
| 5,423,232 | A | 6/1995 | Miller et al. | |
| 5,546,824 | A | 8/1996 | Miller et al. | |
| 6,155,376 | A | 12/2000 | Cheng | |
| 6,626,261 | B1 * | 9/2003 | Kurokawa et al. | 180/444 |
| 6,637,280 | B2 * | 10/2003 | Potts | 74/87 |
| 6,769,838 | B2 * | 8/2004 | Potts | 74/87 |
| 6,829,986 | B2 * | 12/2004 | Richter | 404/117 |
| 7,059,802 | B1 | 6/2006 | Geier et al. | |
| 7,469,851 | B2 | 12/2008 | Bartosch | |
| 7,979,988 | B2 * | 7/2011 | Shiino et al. | 29/893.31 |
| 2004/0005191 | A1 * | 1/2004 | Geier et al. | 404/117 |
| 2009/0000120 | A1 | 1/2009 | Shiino et al. | |

* cited by examiner

*Primary Examiner* — Gary S Hartmann
(74) *Attorney, Agent, or Firm* — Boyle Fredrickson, S.C.

(57) ABSTRACT

A vibratory roller is provided with an exciter assembly that need not be lubricated by an oil bath because the exciter gears need not be lubricated. At least an outer ring portion of at least one gear of the exciter assembly is formed from a non-metallic material. In one embodiment, a first gear is a composite gear having an outer toothed ring portion formed from a machined nylon material imbedded with at least one of a heat stabilizer and a lubricant, and a second, mating gear is formed from metal and acts as heat sink for the first gear. In another embodiment, both the first and second gears are composite gears having an outer toothed ring formed from a robust and thermally stable molded polymer. The gears can survive when the roller is operated at least 8 hours at a duty cycle of at least 50% while operating the roller at an ambient temperature of over 38° C. (100° F.) and while the exciter shaft is driven at a velocity of over 2,000 RPM and the exciter housing is subjected to over 31.13 kN (7,000 lbf) of centrifugal forces at a vibrational frequency of over 40 Hz.

15 Claims, 7 Drawing Sheets

VIBRATORY ROLLER WITH COMPOSITE EXCITER DRIVE GEAR

BACKGROUND OF THE INVENTION

1. Field of the Invention

The invention relates to a vibratory compactor such as a "vibratory roller" that may be used, e.g., to compact back-filled trenches after a pipeline is laid or to compact the floor of a trench prior to laying a pipeline and, more particularly, relates to a vibratory compactor of the above-mentioned type and having an exciter assembly including one or more unlubricated gears. The invention additionally relates to a method of operating such a roller.

2. Discussion of the Related Art

Vibratory compactors are used in a variety of ground compaction and ground leveling applications. Most vibratory compactors have plates or rollers that rest on the surface to be compacted and that are excited to vibrate so as to compact and level the worked surface. A common vibratory compactor, and one to which the invention is well-suited, is a vibratory trench roller.

The typical vibratory trench roller includes a chassis supported on the surface to be compacted by one or more rotating drum assemblies. Two drum assemblies are typically provided, each of which supports a respective subframe of the chassis. The subframes may be articulated to one another by a pivot connection. Each of the drum assemblies typically includes a stationary axle housing and a drum that is mounted on the axle housing and that is driven to rotate by a dedicated hydraulic motor. All of the hydraulic motors are supplied with pressurized hydraulic fluid from a pump powered by an internal combustion engine mounted on one of the subframes. In addition, each drum is excited to vibrate by a dedicated exciter assembly that is located within the associated axle housing and that is powered by a hydraulic motor connected to the pump. The exciter assembly typically comprises one or more eccentric masses mounted on a rotatable shaft positioned within the axle housing. The vibratory system in widest use today is composed of two synchronized counter-rotating shafts, each of which bears one or more eccentric weights. The shafts are operationally mated to one another via two intermeshing gears. A first one of the shafts is driven by a hydraulic motor or similar drive, and the other shaft is driven by the first shaft via operation of the intermeshing gears. This arrangement allows the forces produced by each shaft to cancel each other in the horizontal plane, but complement each other in the vertical plane. The resulting force is more effectively transmitted to the ground and also reduces the vibrations transmitted to the rest of the machine. Vibratory trench rollers of this basic type are disclosed, e.g., in U.S. Pat. Nos. 4,732,507 to Artzberger, 5,082,396 to Polacek, and 7,059,802 to Geier et al.

The entire machine is configured to be as narrow as practical so as to permit the machine to fit within a trench whose floor is to be compacted. Machine widths of under 1 meter (3 feet) are common. This width minimization is made possible by, among other things, housing the vibratory exciter and its included exciter assemblies at least in part within the footprint of the drum. However, housing the exciter within the drum makes the vibratory system more difficult to access for routine maintenance.

The exciter assemblies of the typical vibratory roller run at moderately high speeds on the order of 1,500 RPM or higher. They also are subject to relatively high shock and vibration loads, and must operate in hot-weather environments for prolonged periods of time. Lubrication of these exciter assemblies is required to increase bearing life and to prevent gear wear and noise. Grease lubrication cannot be used on the gears because the grease will not stay on the gear teeth at the rated rotational speed. The exciter assemblies therefore are lubricated via an oil bath. That is, the housing in which each exciter assembly is mounted is filled with a lubricating oil to a level that is typically above the bottom of the gears and just touching the bottom of the eccentric weight when the roller is on a horizontal surface. This lightly contacts the oil to provide splash lubrication.

However, referring to FIG. 10, when the vibratory roller is operated on a slope, as is often experienced when compacting trenches, the oil O flows to one side of the exciter housing H. As a result, one of the gears G1 is immersed in the oil more deeply than desired, resulting in aggressive splashing of oil, creating additional friction and heat. The other gear G2 is not immersed in oil at all. Elevated heat reduces the life of the bearings and seals and also beaks down the lubrication properties of the oil. This requires the periodic replacement of the oil to insure proper lubrication. This maintenance is somewhat burdensome, particularly given that lubricant drain and fill ports are relatively inaccessible in compact trench rollers. In addition, some operators tend not to replace the oil at the required frequency, resulting in premature failure of exciter components.

In addition, any system requiring an oil bath is prone to oil leaks. That is particularly true in the case of vibratory rollers in which the severe vibrations resulting from roller operation can lead to rapid degradation of seals and to the loosening of bolts that connect the components of the exciter assembly housing to one another. These leaks can accelerate wear and failure due to under-lubrication and also present an environmental hazard.

The need therefore has arisen to provide a vibratory roller having an exciter assembly that does not require an oil bath, hence negating the need to maintain a designated level of oil in an exciter assembly housing and immunizing the roller from the detrimental effects of operating on a slope.

SUMMARY OF THE INVENTION

In accordance with a first aspect of the invention, the above-identified and other needs are met by providing a vibratory roller with an exciter assembly that need not be lubricated by an oil bath. Preferably, the exciter assembly includes an exciter housing, an exciter shaft rotatably journaled in the exciter housing, an eccentric weight supported on the exciter shaft, and a gear mounted on the exciter shaft. The gear is unlubricated and has at least an outer ring portion being formed from a non-metallic material. The term "unlubricated," as used herein, means the gear is not externally lubricated, such as by an oil bath or a system that sprays or otherwise delivers lubricant to the gear from a source that is external to the gear. Some non-metallic materials, such as some polymers, are self-lubricating to the extent that they are formed from a relatively low friction material and/or have a lubricant imbedded in them that reduces the friction of the meshing teeth during operation. Gears formed at least in part from such materials are "unlubricated" within the meaning of that term as used herein. The unlubricated gear may, for instance, be a composite gear formed from an inner metal hub and an outer ring formed from the non-metallic material.

In one embodiment, a first one of the gears is formed from a composite gear having a non-metallic outer ring and an inner metal hub, and the second gear is formed entirely from metal. The metal gear acts as a heat sink that helps cool the composite gear, and the material of the outer ring of the composite gear helps reduce friction at the mating teeth of both gears. The non-metallic material of the composite gear's outer ring may, for instance, be a nylon-based polymer impregnated with at least one of a heat stabilizer and a lubricant.

In another embodiment, both the first and second gears are composite gears having an inner metal hub and an outer ring formed from a non-metallic material, such as a molded polymer.

In accordance with another aspect of the invention, a method is provided of operating a vibratory roller in the absence of an oil bath. The vibratory roller has an exciter assembly having a gear having at least an outer toothed portion formed from a non-metallic material. The method includes operating the roller at least 8 hours at a duty cycle of at least 25%, without lubricating the gear, while operating the roller at an ambient temperature of over 38° C. (100° F.) and while the exciter shaft is driven at a velocity of over 1,500 RPM and the exciter housing is subjected to over 22.25 kN (5,000 lbf) of centrifugal forces at a vibrational frequency of over 25 Hz. Preferably, the roller can be operated at least 8 hours at a duty cycle of at least 50%, without lubricating the gear, while operating the roller at an ambient temperature of over 38° C. (100° F.) and while the exciter shaft is driven at a velocity of over 2,000 RPM and the exciter housing is subjected to over 31 kN (7,000 lbf) of centrifugal forces at a vibrational frequency of over 40 Hz.

A roller as described above can be operated for at least 125 million exciter shaft revolutions, and preferably for at least 200 million exciter shaft revolutions, without gear failure.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Preferred embodiments of the invention will now be described in conjunction with a vibratory trench roller having two drums and a bathless exciter assembly provided in each drum. It should be understood that the invention as described herein is applicable to a variety of other single roller or multiple roller compactors other than the one specifically disclosed herein. The exciter assemblies described herein and other exciter assemblies falling within the scope of the present invention are usable with a variety of different vibratory compactors using an exciter assembly to impart vibrations to a compaction device. They are especially well suited for use in vibratory rollers having one or more rotating drums. Examples will now be described in conjunction with a vibratory trench roller, with the understanding that they are usable in a variety of other applications as well.

Figure 1:
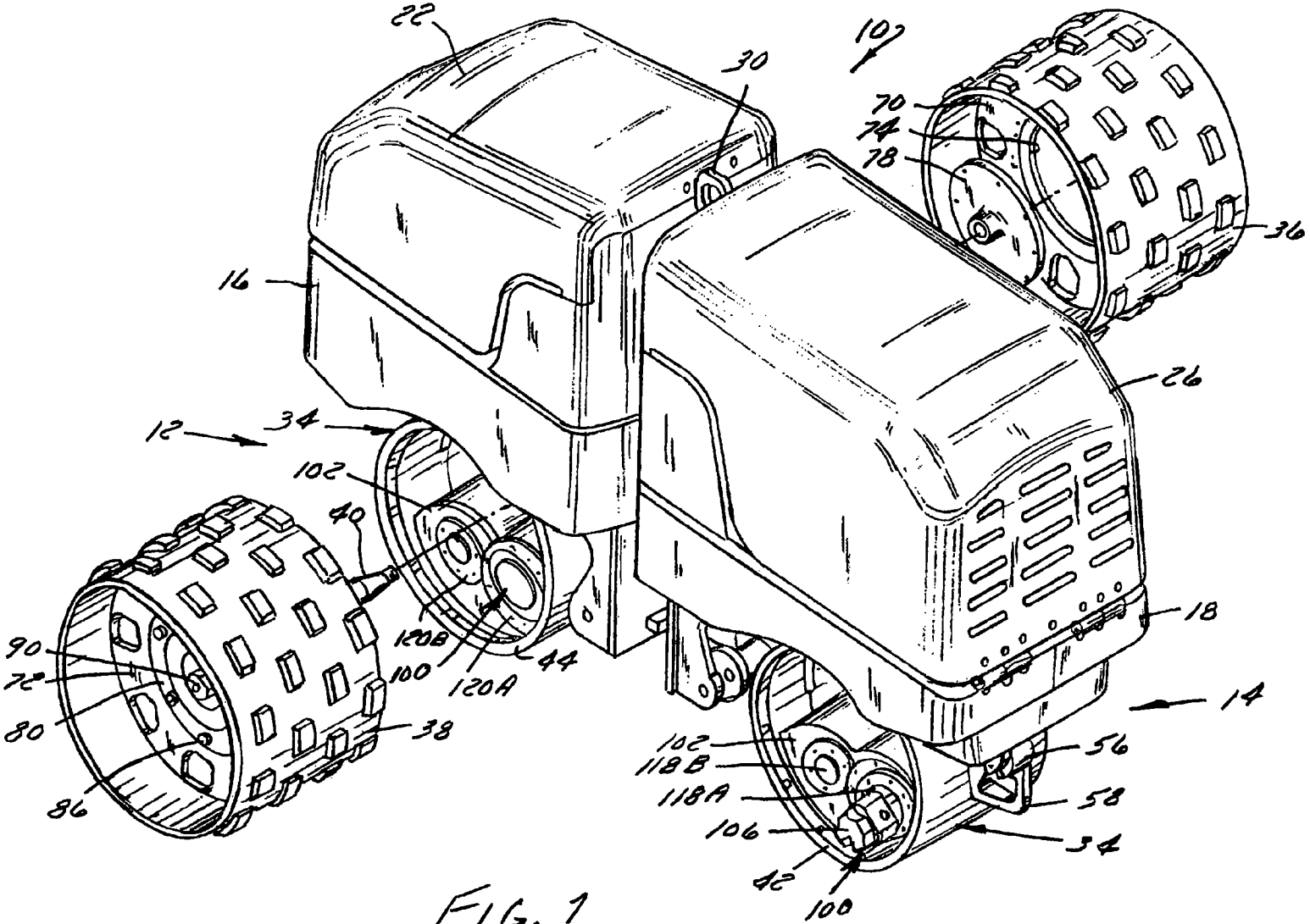
FIG. 1 is a partially exploded perspective view of a vibratory trench roller constructed in accordance with a preferred embodiment of the invention.

Referring now to FIG. 1, a vibratory trench roller 10 is illustrated that is constructed in accordance with a preferred embodiment of the invention. The roller 10 is a so-called walk-behind trench roller comprising a self-propelled machine supported on the ground via rear and front rotating drum assemblies 12 and 14. The machine 10 comprises an articulated chassis having rear and front subframes 16 and 18 connected to one another via a pivot connection (not shown). The chassis is only about 0.5 meters (20 in) wide. This narrow width is important to permit the roller 10 to be used to compact the bottom of trenches for laying pipeline and the like. The rear subframe 16 supports controls for the machine (not shown) as well as an enclosed storage compartment accessible via a pivotable cover 22. The front subframe 18 supports an engine accessible via a ventilated hood 26. The engine supplies motive power to a pump that generates hydraulic pressure used to drive all hydraulically powered components of the roller 10. The engine, pump, and related components may be standard for machines of this type and, accordingly, need not be described in greater detail herein. The roller 10 can be lifted for transport or deposited in a trench whose floor is to be compacted by connecting a chain or cable to a lift eye 30 located at the front of the rear subframe 16.

The rear and front drum assemblies 12 and 14 are mirror images of one another. The primary difference between the two drum assemblies is that the drive motor for the exciter assembly of the front drum assembly 14 is mounted in the associated axle housing from the right side of the machine 10, and the drive motor for the exciter assembly for the rear drum assembly 12 is inserted into the associated axle housing from the left side of the machine 10. The construction and operation of the front drum assembly 14 will now be described, it being understood that the description applies equally to the rear drum assembly 12. Those interested in these aspects of the roller 10, as well as other aspects that do not specifically relate to the exciter assemblies, may refer to U.S. Pat. No. 7,059,802, the subject matter of which is incorporated herein by reference in its entirety.

Each of the drum assemblies 12 and 14 is excited to vibrate by a separate exciter assembly 100. Both exciter assemblies 100 are identical, except for the fact that they are mirror images of one another so that their drive motors 106 (detailed below) are located at opposite sides of the machine 10. The following description of the front exciter assembly therefore is equally applicable to both exciter assemblies.

Figure 2:
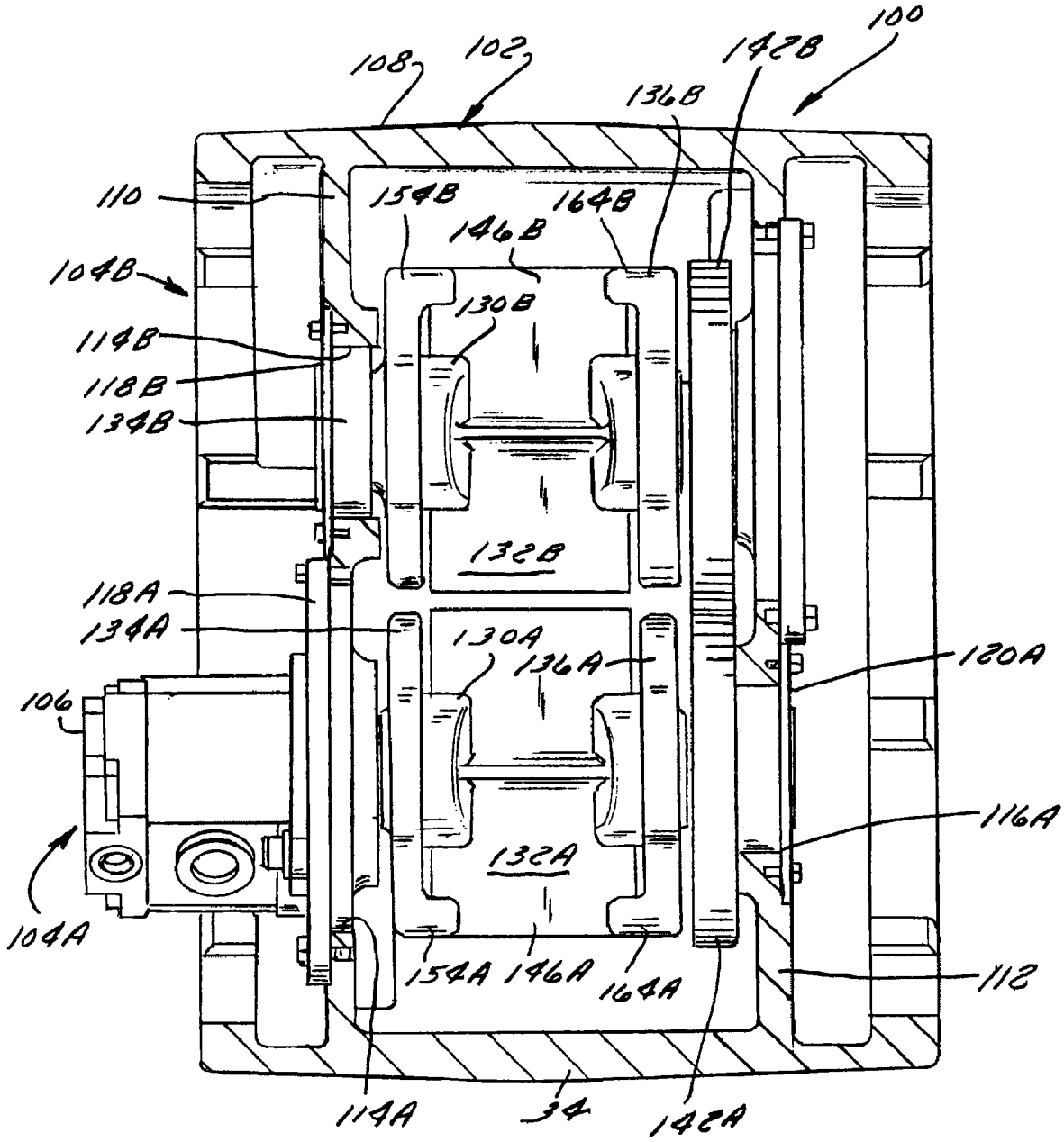
FIG. 2 is a sectional plan view of an axial housing of the trench roller of FIG. 1.
Figure 3:
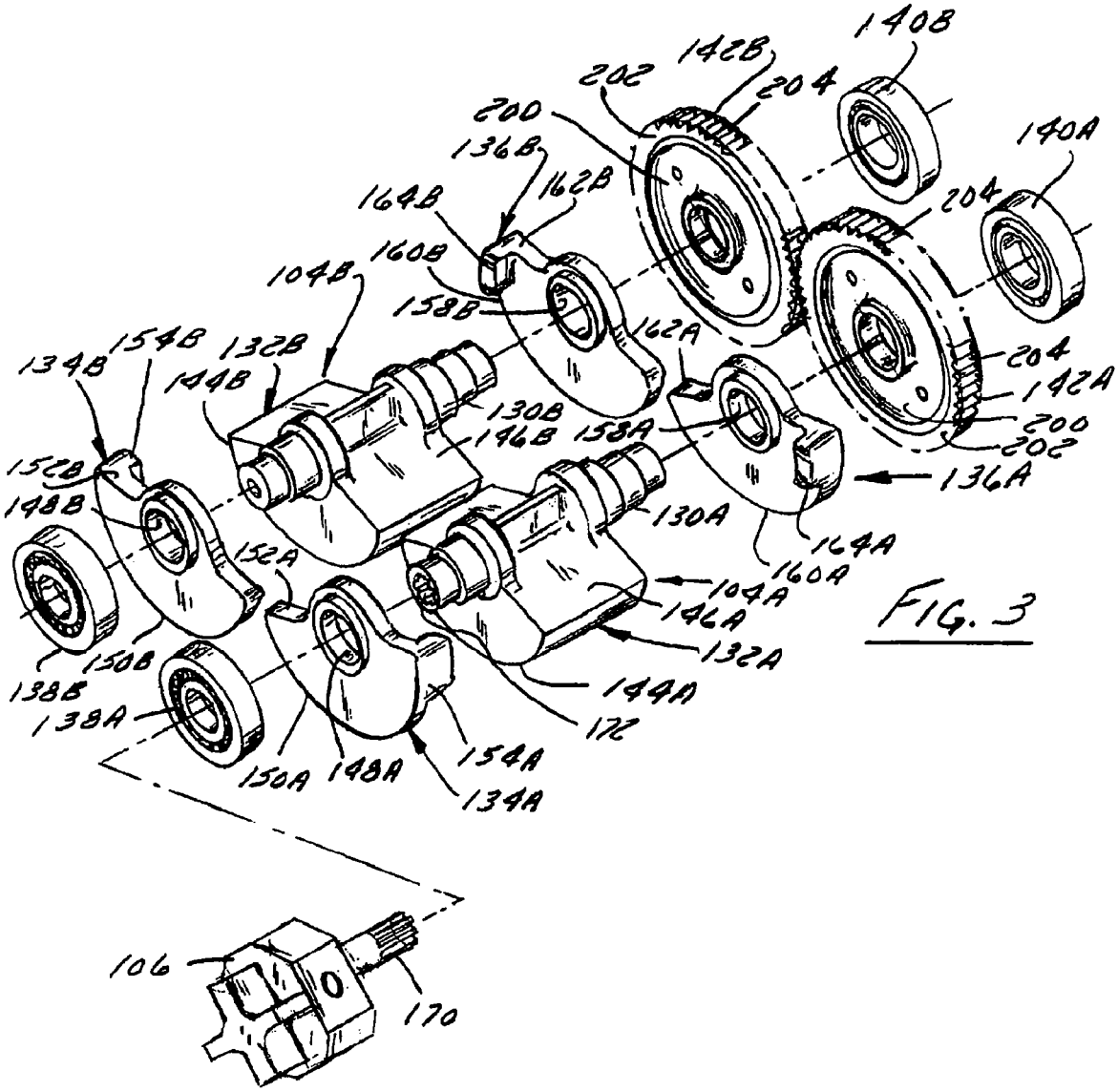
FIG. 3 is an exploded perspective view of a first embodiment of an exciter assembly of the trench roller of FIG. 1.

Referring now to FIGS. 2 and 3, the exciter assembly 100 for the front drum assembly 14 includes first and second exciter subassemblies 104A and 104B. The first exciter subassembly 104A is driven directly by a reversible hydraulic motor 106, and the second exciter subassembly 104B is slaved to the first exciter subassembly 104A. Both subassemblies 104A and 104B are designed to maximize ease of assembly and to minimize weight and size. Both subassemblies 104A and 104B are mounted in an exciter housing 102 located within the axle housing 34 of the front drum assembly 14.

Referring to FIGS. 1-3, the exciter housing 102 is formed integrally with the interior surface the axle housing 34 to facilitate assembly and to reduce the weight of the machine. It has an open interior encased by a radial peripheral wall 108 (a portion of which is formed integrally with the radial peripheral wall of the axle housing 34) and has opposed end walls 110 and 112, designated "left" and "right" end walls herein because they are viewed from the front of the machine in the drawings and, accordingly, are located at the left and ride side portions of the drawings, respectively. Each end wall 110, 112 has first and second bores formed therethrough for receiving a respective left and right end of the associated exciter subassembly 104A and 104B.

Referring especially to FIGS. 2 and 3, the first exciter subassembly 104A includes an exciter shaft 130A, a fixed eccentric weight 132A, and first and second free swinging weights 134A and 136A disposed adjacent opposite axial ends of the fixed weight 132A. The exciter shaft 130A is mounted in the exciter housing 102 by left and right bearings 138A and 140A that are pressed onto opposite ends of the exciter shaft 130A. The first free swinging weight 134A is sandwiched between the left bearing 138A and the left axial end of the fixed weight 132A. However, the first free swinging weight 134A is not otherwise coupled to any other element of the exciter subassembly 104A. Movement along the exciter shaft 130A is restrained solely by the fixed weight 132A and the bearing 138A. A drive gear 142A is pressed onto the right end of the exciter shaft 130A between the bearing 140A and the fixed eccentric weight 132A with the second free swinging weight 136A sandwiched between the drive gear 142A and the right end of the fixed weight 132A. As with the first eccentric weight 134A, the second eccentric weight 136A is restrained from axial movement along the exciter shaft 130A solely by the fixed eccentric weight 132A, the drive gear 142A, and the right bearing 140A.

All three weights 132A, 134A, and 136A of exciter subassembly 104A are designed to maximize eccentricity while minimizing the overall inertia of the exciter assembly 100. Still referring to FIGS. 2 and 3, the fixed weight 132A is relatively massive, having an axial length that exceeds the combined axial length of both free swinging weights 134A and 136A. It is generally semi-cylindrical in shape to maximize its eccentricity and, therefore, has (1) an arcuate outer radial peripheral surface 144A and (2) a relative flat inner radial edge surface 146A formed from two portions extending generally radially from opposite sides of the exciter shaft 130A. Preferably, in order to facilitate assembly and reduce inertia, the fixed weight 132A is cast integrally with the exciter shaft 130A as best seen in FIG. 3. The first free weight 134A comprises a cast metal member having a through-bore 148A for mounting on the associated portion of the exciter shaft 130A.

The first and second free swinging weights 134A and 136A are mirror images of each other. The description that follows therefore will be limited to the first swinging weight 134A, it being understood that it applies equally if not equally to the second free swinging weight. As with the fixed eccentric weight 132A, the first free swinging weight 134A is highly eccentric, having (1) an arcuate outer surface 150A and (2) a relatively flat inner surface 152A formed by first and second portions extending generally radially from opposite sides of the exciter shaft 130A. A tab 154A extends axially inwardly from an axial surface of the free swinging weight 134A so as to protrude over the adjacent outer axial edge of the fixed weight 130A. When the exciter shaft 130A is driven to rotate in a first direction, the free swinging weight 134A swings to an angular position in which one side of the tab 154A engages a first side of the fixed weight 132A and in which the eccentricity of the free swinging weight 134A adds to the eccentricity of the fixed weight 132A, thereby increasing the vibrational amplitude of the exciter subassembly 104A. Conversely, when the exciter shaft 130A is driven to rotate in the opposite direction, the free swinging weight 134A swings to an angular position in which the opposite side of the tab 154A engages the opposite side of the fixed weight 132A and in which the eccentricity of the free swinging weight 134A detracts from the eccentricity of the fixed weight 132A, thereby reducing the vibrations generated by the exciter subassembly 104A.

Still referring to FIGS. 2 and 3, the first exciter subassembly 104A is driven by the coaxial reversible hydraulic motor 106. An output shaft 170 of the motor 106 and is affixed directly to the axial end of the exciter shaft 130A.

The second exciter subassembly 104B is essentially identical to the first exciter subassembly 104A except for the fact that it is driven indirectly by the first exciter subassembly 104A as opposed to being driven directly by a motor. It therefore includes an exciter shaft 130B, a fixed eccentric weight 132B, first and second free swinging weights 134B, 136B, a driven gear 142B, and left and right bearings 138B and 140B. Torque is transferred to the driven gear 142B directly by the drive gear 142A on the first exciter subassembly 104A as best seen in FIG. 3.

The bearings of the exciter assembly 100 preferably are lubricated via a relatively high viscosity grease that is not ejected from the bearings at high speeds. A suitable grease is available from Mobile Exxon Corp. under the brand name XHP 222.

During operation of a trench roller 10, the roller 10 is positioned at the bottom of a trench or on another surface to be compacted, and the engine 24 and pump 28 are operated to supply drive torque to the axles 40 of the drum assemblies 12, 14 via the drive gears 92, thereby propelling the trench roller 10 along the surface to be compacted. The exciter assembly drive motors 106 are simultaneously operated to supply drive torque to the exciter assemblies 100, thereby generating vibrations of a magnitude that vary depending upon the direction of motor output shaft rotation. The exciter assemblies 100 are driven up to speed very quickly during start up under relatively high drive torques due to the high inertia of the relatively heavy exciter assemblies 100.

As mentioned above, the exciter housing 102 is bathless, and the gears 142A and 142 B are unlubricated, meaning, that they are not externally lubricated by grease, an oil bath, or an oil application system. Providing a bathless gear set proved no easy feat given the fact that the vibratory trench roller 10 must be operated under relatively extreme conditions. The exciter shafts 130A and 130B must be driven at relatively high speeds, typically at a velocity of over 1,500 RPM and, depending on the design requirements of the machine possibly over 2,500 rpm. The exciter shafts of some other rollers, such as vibratory asphalt rollers, may rotate at over 4,000 rpm. These speeds are maintained at a duty cycle that is typically of at least 25%, and more typically of about 50% or more of the operating time of the machine, which may occur uninterrupted for four hours or more and even of eight hours or more. The machine must be capable of operating in extreme ambient conditions ranging from −18° C. (0° F.) to over 38° C. (100° F.) and even up to 49° C. (120° F.) or above for those periods of time. In addition, the exciter assemblies impose extreme vibrations in the exciter housing and the accompanying components. At an exciter shaft operating speed of 1,500 RPM, the exciter housing may be subjected to over 22.25 kN (5,000 lbf) of centrifugal forces at a vibrational frequency of over 25 Hz. Indeed, at an exciter shaft operating speed of 1,500 RPM, the housing is subjected to over 31.14 kN (7,000 lbf) and up to 33.37 kN (7,500 lbf) of centrifugal forces at a vibrational velocity of over 40 Hz and up to 42 Hz. To achieve an acceptable operating life, the gears must survive these conditions for at least 125,000,000 cycles and preferably over 200,000,000 cycles and up to 225,000,000 cycles. Unlubricated gears, be they composite or other otherwise, were not heretofore considered to be acceptably robust and heat and wear resistant to meet these operating conditions.

Nevertheless, the inventors have developed two different exciter assembly designs that meet the operating requirements described in the preceding paragraph. These designs will now be described in conjunction with FIGS. 4-5 and 6-8, respectively.

Figure 5:
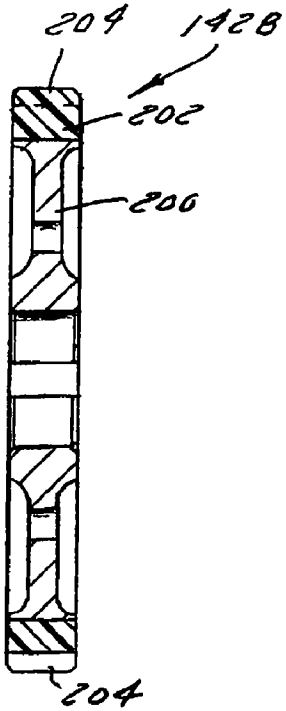
FIG. 5 is a sectional elevation view of one of the gears of the exciter assembly of FIGS. 3 and 4, taken generally along the lines "5-5" in FIG. 4.
Figure 4:
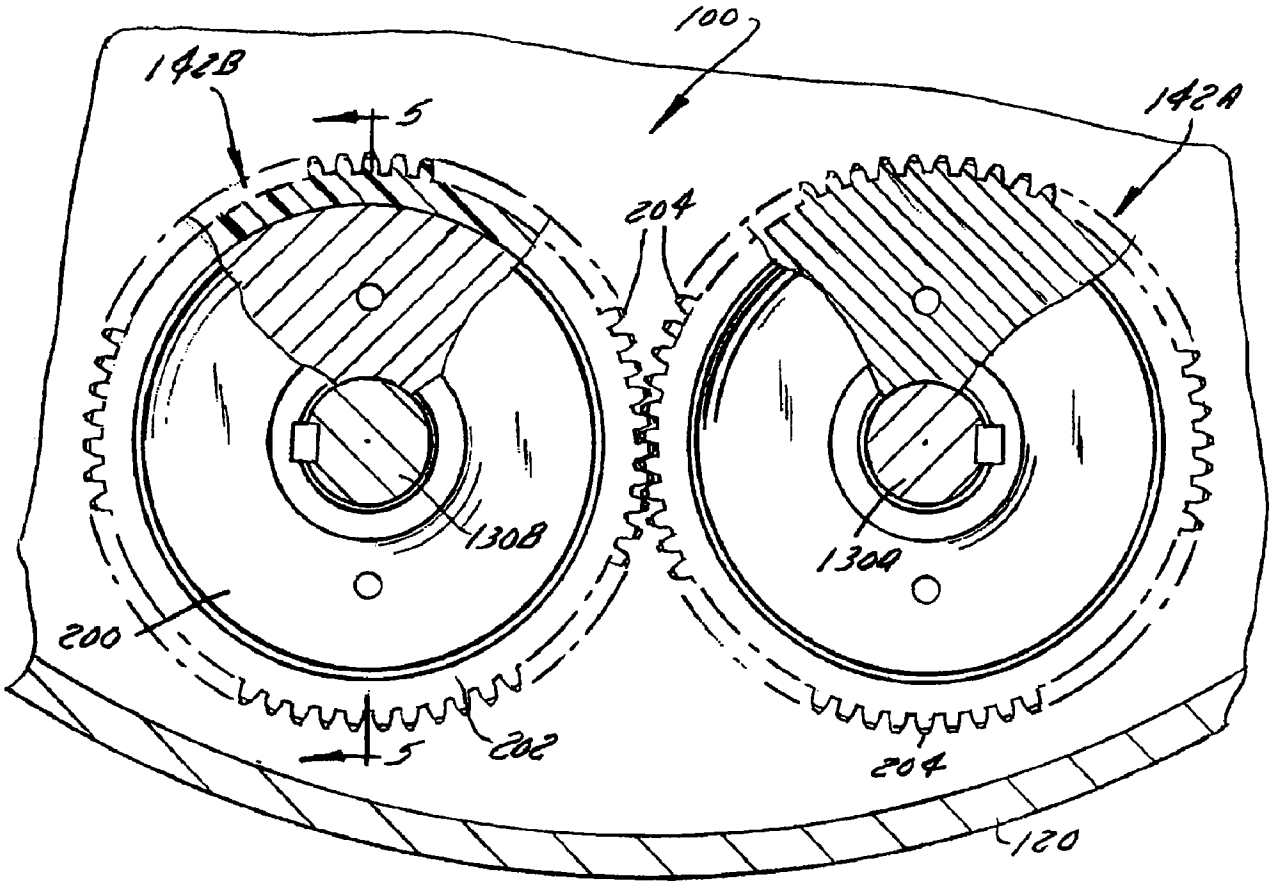
FIG. 4 is a sectional elevation view of a portion of the exciter assembly of FIG. 3, showing the gears of the exciter assembly in partial cut-away.

Turning first to FIGS. 4 and 5, an exciter assembly having a gear set meeting the above requirements is illustrated that includes a first, composite gear 142B and a second, all-metal gear 142A. Both gears 142A and 142B are spur gears. The metal gear 142A acts as a heat sink for the composite gear 142B, enhancing the survivability of the composite gear 142B under extreme operating conditions. The metal gear 142A may be formed from steel or, conceivably, aluminum or another metal or metal alloy. Both gears 142A and 142B have a width of about 19 mm (0.75 in), a major or outside diameter of about 160 mm (6.30 in) and a root diameter of about 150 mm (5.91 in).

The composite gear 142B has an inner metal hub 200 keyed to the shaft 130B and an outer toothed ring 202 formed from an unlubricated nonmetallic material. The inner hub 200 may be formed from steel or, conceivably, aluminum, or another metal or metal alloy. It preferably has a diameter of about 130 mm (5.12 in).

The outer ring of this embodiment is formed from a hobbed or machined polymer material. It has a radial thickness of about 15 mm (0.59 in). Sixty-three teeth 204 are provided on the gear 142B, utilizing a normal diametral pitch of about 0.39 teeth per mm (10 teeth per inch) and a pressure angle of 20 degrees. A variety of plastics and other nonmetallic materials might suffice for use as the ring 202. Nylon impregnated with a lubricant and/or a heat stabilizer has been found to be acceptable. An especially preferred material is used in composite gears manufactured by Duragear, Inc. of Edgerton, Wis., U.S.A. and is available from Quadrant Engineering Plastic Products under the trade name Nylatron® MC® 901. Nylatron MC 901 is a cast nylon having in imbedded heat stabilizer. The Nylatron MC 901 has a melting temperature of 215° C. (419° F.), a Young's modulus of 2,760 MPa, and a tensile strength of 82.7 MPa.

It should be noted that the Nylatron® MC® 901 nylon-based material and other, similar nylon-based materials impregnated with a heat stabilizer and/or a lubricant expand more under given operating conditions than a comparable metal gear. The gear set 142A, 142B of this embodiment is imparted with greater than traditional backlash to accommodate this expansion. The gear set preferably is provided with a backlash in excess of 0.08 mm (0.003 in) and more preferably of about 0.25 mm (0.010 in) or more.

An exciter assembly having a gear set described above was subjected to temperature and endurance testing. For maximum temperature testing, a trench roller having such a gear set was operated at an ambient temperature of 49° C. (120° F.) for eight continuous hours. The temperature was observed to exceed 91° C. (195° F.) at the gear teeth. The test was then run at an exciter shaft velocity of 2,500 RPM for 24 hours a day, seven days a week, with the gears being inspected at regular intervals. The test was stopped after over 900 hours of operation (over 135 million exciter shaft revolutions) without gear failure. These tests confirmed that the gears as described according to this embodiment met design requirements.

Figure 7:
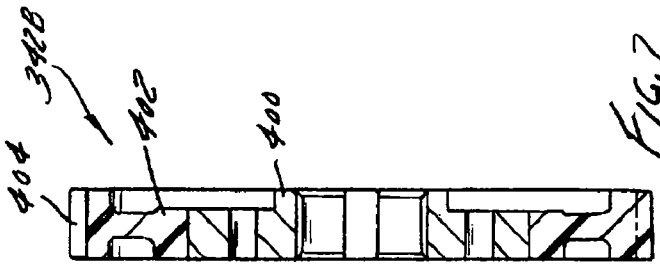
FIG. 7 is a sectional elevation view of one of the gears of the exciter assembly of FIG. 6, taken generally along the lines "7-7" in FIG. 6.
Figure 8:
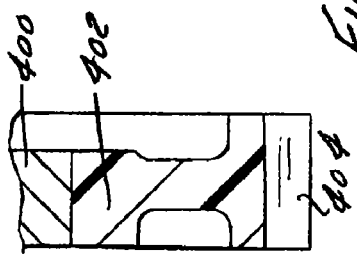
FIG. 8 is a detail view of a portion of the gear of in FIG. 7.
Figure 6:
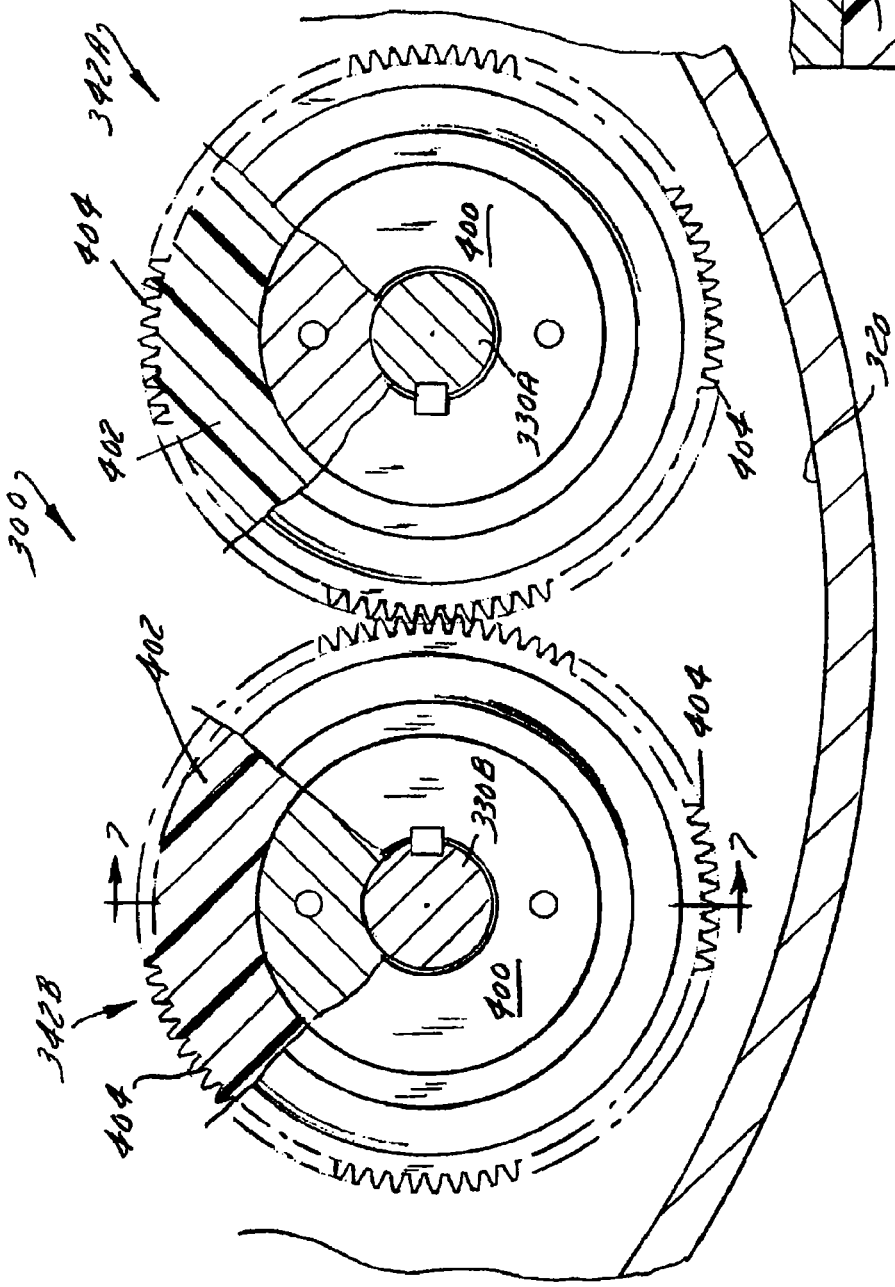
FIG. 6 is a sectional elevation view of a portion of an exciter assembly constructed in accordance of a second embodiment of the invention, showing the gears of the exciter assembly in partial cut-way.

Turning now to FIGS. 6-8, a portion of an exciter assembly 300 constructed in accordance with a second embodiment of the invention is illustrated. The exciter assembly 300 of this embodiment differs from the exciter assembly 100 at the first embodiment only in that a different gear set 342A, 342B is employed. Specifically, both gears 342A and 342B are composite gears having an inner metal hub 400 and an outer non-metallic ring 402. The hub 400 preferably is formed from aluminum but could be formed from steel or another metal or metal alloy. Each gear 342A, 342B has an axial thickness of about 19 mm (0.75 in), a major or outside diameter of about 160 mm (6.38 in), and a root diameter of about 150 mm (5.97 in). As best seen in FIGS. 7 and 8, the hub of each gear 342A, 342B has a diameter of 95 mm (3.75 in), and the outer toothed ring has a radial thickness of 33 mm (1.31 in).

The outer ring 402 of each gear 342A, 342B is formed from a polymer material that is formed by injection molding rather than being machined or hobbed as in the first embodiment. A currently preferred material is polyether ether ketone (PEEK™), which is very robust, having a Young's modulus of 3,600 MPa and tensile strength of on the order of 100 MPa. It is also well suited for high-temperature applications, having a glass transition temperature of over 140° C. (285° F.). Because the PEEK material has a much higher heat threshold than the Nylatron® MC® 901 material of the outer ring of the first embodiment, there is no need for either an imbedded heat stabilizer or a separate heatsink. A composite gear having an outer toothed ring formed from PEEK is commercially available, e.g., from Kleiss Gears, Inc. of Grantsburg, Wis. U.S.A.

Figure 9:
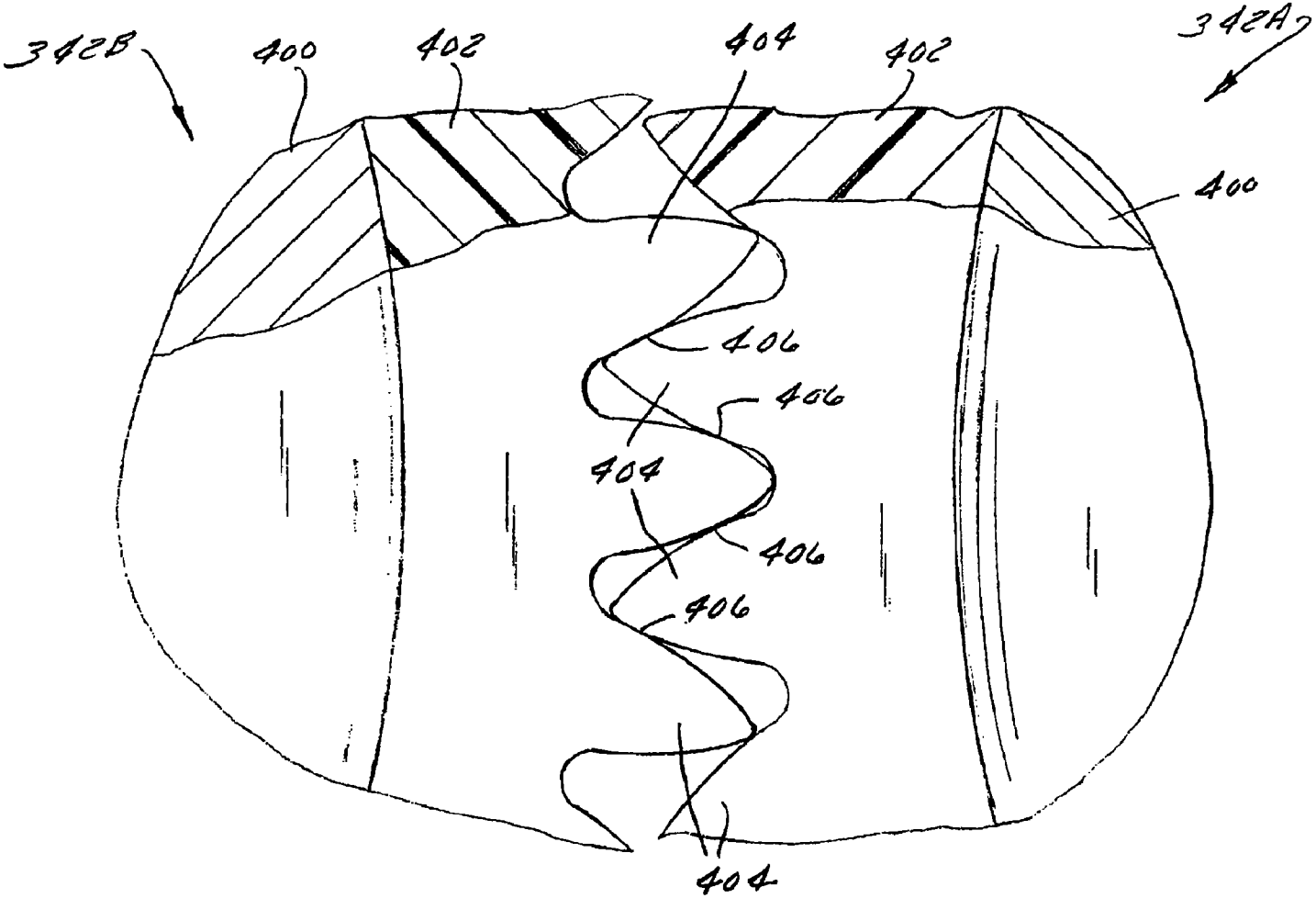
FIG. 9 is a detail view showing the meshing of the gears of the exciter assembly of FIGS. 6 and 7.
Figure 10:
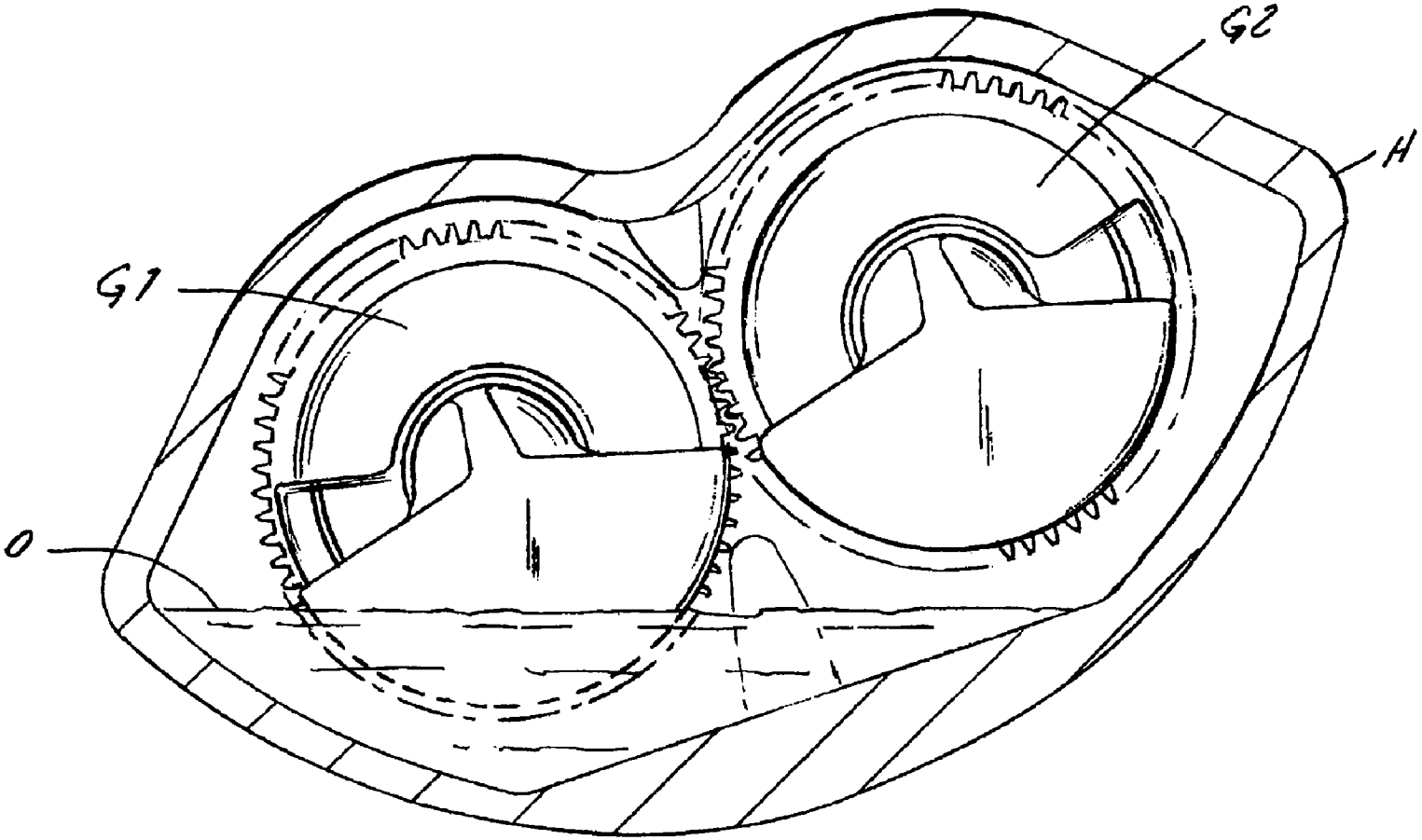
PRIOR ART FIG. 10
FIG. 10 is a sectional view of an exciter assembly constructed in accordance with the prior art, appropriately labeled "PRIOR ART."

Ninety teeth 404 are formed on the outer ring 402 of each gear 342A, 342B, utilizing a normal diametral pitch of 0.57 teeth per mm (14.55 teeth per in) and a pressure angle of 19 degrees. Referring especially to FIG. 9, the teeth 404 are shaped so as to maximize contact area 406 and, hence, to maximize tooth strength. Each tooth 404 has a base pitch of 0.20 and a maximum contact ratio of 2.6. When compared to a "standard" spur gear design for spur gears commonly used in applications of this type, the teeth have a higher contact ratio.

Many changes and modifications could be made to the invention without departing from the spirit thereof. For instance, the inventive exciter assembly is usable with a variety of ground compactors other than a multi-drum trench roller. The invention is also applicable to exciter assemblies having only a single exciter subassembly as opposed to two exciter subassemblies. The scope of other changes will become apparent from the appended claims.

We claim:

1. A vibratory roller comprising:

(A) a chassis;

(B) at least one roller on which the chassis is supported;

(C) an exciter assembly that imparts vibrations to the roller to compact materials over which the roller travels, the exciter assembly comprising i. an exciter housing;

ii. an exciter shaft rotatably journaled in the exciter housing;

iii. an eccentric weight supported on the exciter shaft, and iv. a gear mounted on the exciter shaft, the gear being unlubricated and having at least an outer ring portion being formed from a non-metallic material.

2. The vibratory roller as recited in claim 1, wherein the gear comprises a composite gear having an inner metal hub and an outer ring of the non-metallic material.

3. The vibratory roller as recited in claim 2, wherein the exciter assembly comprises a first exciter subassembly of larger exciter assembly, the exciter shaft comprises a first exciter shaft, and the gear comprises a first gear, and further comprising i) a second exciter subassembly comprising a second exciter shaft rotatably journaled in the exciter housing and bearing an eccentric weight and ii) a second gear that is supported on the second exciter shaft, and that meshes with first gear, and that is of at least generally the same diameter as the first gear.

4. The vibratory roller as recited in claim 3, wherein the second gear has a metallic outer portion.

5. The vibratory roller as recited in claim 3, wherein the gears have a backlash of at least 0.20 mm (0.008 in).

6. The vibratory roller as recited in claim 5, wherein the gears have a backlash of at least 0.25 mm (0.010 in).

7. The vibratory roller as recited in claim 3, wherein the outer ring portion of the first gear is formed from a nylon-based polymer impregnated with at least one of a heat stabilizer and a lubricant.

8. The vibratory roller as recited in claim 3, wherein the second gear is a composite gear having a metal hub having an outer ring of the non-metallic material.

9. The vibratory roller as recited in claim 8, wherein the outer ring of the first gear is formed from a molded polymer.

10. The vibratory roller as recited in claim 1, wherein the eccentric weight is a fixed eccentric weight that is rotationally fixed relative to the exciter shaft, and wherein the exciter assembly further comprises a free swinging weight that is mounted on the exciter shaft so as to rotate with respect to the exciter shaft between 1) a first angular position in which the eccentricity of the free swinging eccentric weight adds to the eccentricity of the fixed eccentric weight and 2) a second angular position in which the eccentricity of the free swinging eccentric weight detracts from the eccentricity of the fixed eccentric weight.

11. A vibratory roller comprising:

(A) a chassis;

(B) first and second rollers on which the chassis is supported;

(C) an exciter housing located at least in part within the first roller and lacking an oil bath therein;

(D) an exciter assembly including first and second exciter subassemblies that impart vibrations to the first roller to compact materials over which the roller travels, each exciter subassembly comprising i. an exciter shaft rotatably journaled in the exciter housing;

ii. an eccentric weight supported on the exciter shaft, and iii. a gear mounted on the exciter shaft, wherein the gears of the first and second exciter subassemblies mesh with one another and are unlubricated, and wherein at least one of the gears has at least a toothed outer portion formed from a non-metallic material.

12. The vibratory roller as recited in claim 11, wherein the first gear is a composite gear having a metal hub and an outer ring formed from a nylon-based polymer impregnated with at least one of a heat stabilizer and a lubricant, and wherein the second gear has a metallic outer portion.

13. The vibratory roller as recited in claim 12, wherein the gears have a backlash of at least 0.20 mm (0.008 in).

14. The vibratory roller as recited in claim 11, wherein each of the first and second gears is a composite gear having a metal hub and an outer ring formed from a molded polymer.

15. The vibratory roller as recited in claim 11, wherein the eccentric weight of each exciter subassembly is a fixed eccentric weight that is rotationally fixed relative to the associated exciter shaft, and wherein each exciter subassembly further comprises a free swinging weight that is mounted on the associated exciter shaft so as to rotate with respect to the exciter shaft between 1) a first angular position in which the eccentricity of the free swinging eccentric weight adds to the eccentricity of the associated fixed eccentric weight and 2) a second angular position in which the eccentricity of the free swinging eccentric weight detracts from the eccentricity of the associated fixed eccentric weight.

* * * * *

UNITED STATES PATENT AND TRADEMARK OFFICE

CERTIFICATE OF CORRECTION

PATENT NO. : 8,328,464 B2
APPLICATION NO. : 13/020976
DATED : December 11, 2012
INVENTOR(S) : Sina et al.

It is certified that error appears in the above-identified patent and that said Letters Patent is hereby corrected as shown below:

IN THE SPECIFICATION:

| | |
|---|---|
| Col. 8, Line 40 | Replace "(PEEK™)" with "(VICTREX® PEEK 450G, or simply PEEK™)" |

Signed and Sealed this
Eleventh Day of June, 2013

Teresa Stanek Rea
*Acting Director of the United States Patent and Trademark Office*